United States Patent [19]

Nakamura et al.

[11] 4,363,518

[45] Dec. 14, 1982

[54] METHOD AND APPARATUS FOR FRACTURING ROCK BEDS

[75] Inventors: Joji Nakamura, Kamakura; Shigetake Akanuma, Chigasaki, both of Japan

[73] Assignee: Kabushiki Kaisha Komatsu Seisakusho, Tokyo, Japan

[21] Appl. No.: 209,704

[22] PCT Filed: Mar. 13, 1979

[86] PCT No.: PCT/JP79/00299

§ 371 Date: Nov. 13, 1980

§ 102(e) Date: Sep. 16, 1980

[87] PCT Pub. No.: WO80/01931

PCT Pub. Date: Sep. 18, 1980

[30] Foreign Application Priority Data

Mar. 13, 1979 [JP] Japan ..... 54-28210
Sep. 28, 1979 [JP] Japan ..... 54-123793
Sep. 28, 1979 [JP] Japan ..... 54-133269

[51] Int. Cl.[3] ..... E21C 37/12

[52] U.S. Cl. ..... 299/14; 299/16; 299/17; 299/20; 166/308

[58] Field of Search ..... 299/13, 16, 17, 20, 299/14; 166/299, 308; 102/333

[56] References Cited

U.S. PATENT DOCUMENTS 1,979,802 11/1934 Kinley ..... 102/333 X
2,104,579 1/1938 Bennett ..... 299/16
4,193,634 3/1980 Nakamura et al. ..... 299/17
4,215,001 7/1980 Elphingstone et al. ..... 166/308 X
4,280,735 7/1981 Lobbe ..... 299/17 X

FOREIGN PATENT DOCUMENTS 48-3021 1/1973 Japan .
50-6059 3/1975 Japan .
52-66701 5/1977 Japan .
52-134802 11/1977 Japan .
53-137102 10/1978 Japan .

*Primary Examiner*—Ernest R. Purser
*Attorney, Agent, or Firm*—Armstrong, Nikaido, Marmelstein & Kubovcik

[57] ABSTRACT

A preliminary fracturing method of a rock bed by spouting highly pressurized water into cracks existing in the rock bed to expand these cracks. The preliminary fracturing method of a rock bed comprises drilling a hole in the rock bed by means of a drilling rod having a cutter blade mounted thereto at the leading end thereof, sealing the leading end of the drilling rod by using rock mucks, injecting a high viscosity fluid from the leading end of the drilling rod into the sealed portion of the hole thereby clogging the cracks, and finally spouting a highly pressurized water or highly pressurized high viscosity fluid from the leading end of the drilling rod thereby expanding the cracks. There is also disclosed an apparatus which is adapted to perform the preliminary fracturing of a rock bed.

11 Claims, 12 Drawing Figures

METHOD AND APPARATUS FOR FRACTURING ROCK BEDS

BACKGROUND OF THE INVENTION

This invention relates to a rock bed preliminary fracturing method and an apparatus for preliminary fracturing rock beds by drilling a hole in the rock bed then injecting water under high pressure into the drilled hole.

In recent years, the capacity of the ripper device has been improved with the development of large-sized bulldozers to such an extent that rock beds with an elastic wave propagating speed (Vp) of about 2,500 m/s can be excavated. However, on the surface of the earth, there are a great many hard rock beds with Vp of 2,000 to 4,000 m/s, and so a greater part of them has been excavated by means of blasting. In recent years, however, the restriction on the use of blasting process has become severe year by year from the viewpoint of safety and public hazard, and so it is presupposed that a mechanical fracturing process will be required in place of the blasting process.

However, in order to excavate such hard rock beds by means of the ripper device only, a very large-sized powerful bulldozer is required, but in view of technical, economical and operability aspects, it is not advantageous to carry out the excavation work by a mere combination of such large-sized bulldozer and ripper device. If, prior to ripping, pressurized water is injected into natural cracks of the rock bed to be excavated so as to expand such cracks thereby weakening and reducing the strength of the rock bed, and thereafter ripping thereof is made, then even rock beds with Vp of about 4,000 m/s can be excavated by means of a currently employed middle-sized ripper device, and therefore this excavation process is advantageous in both technical and economical aspects.

SUMMARY OF THE INVENTION

It is therefore an object of the present invention to provide a method and an apparatus for preliminary fracturing a rock bed by injecting a highly pressurized high viscosity fluid or pressurized water into a drilled hole of the rock bed.

Another object of the present invention is to provide a method of fracturing a rock bed by ripping after the rock bed is preliminary fractured by injecting a highly pressurized high viscosity fluid or pressurized water into a drilled hole of the rock bed.

A further object of the present invention is to provide an apparatus for preliminary fracturing a rock bed which is capable of continuously performing a drilling of the rock bed and a preliminary fracturing of the rock bed by injecting a highly pressurized high viscosity fluid or highly pressurized water.

In accordance with an aspect of the present invention, there is provided a preliminary fracturing method of a rock bed, comprising: drilling a hole in said rock bed to be fractured by means of a drilling rod, said drilling rod having a bit or cutter blade mounted thereon at the leading end thereof and a passage formed therein along the entire length of said rod, said passage leading to a nozzle formed in said bit; sealing a leading end portion of the drilled hole by a powder material such as rock muck or sand with said drilling rod remaining inserted in the hole, said leading end portion including said nozzle; spouting a highly pressurized viscosity fluid from said nozzle thereby allowing said viscosity fluid to intrude into cracks existing in said rock bed and clogging them, and further conntinuously spouting said highly pressurized viscosity fluid to expand said cracks and to produce a lot of new cracks in said rock bed.

In accordance with another embodiment of the present invention, after clogging the cracks existing in the rock bed, spouting of the highly pressurized fluid is stopped and then highly pressurized water is spouted from said nozzle to expand the cracks in the rock bed. This embodiment can be usable where cracks existing in the rock bed are neither big nor many in number.

In accordance with another aspect of the present invention, there is provided an apparatus for preliminary fracturing a rock bed, comprising: a guide member adapted to be mounted on a construction vehicle; drifter means movably mounted on said guide member; drilling rod means slidably and rotatably mounted in said drifter means, said drilling rod means having a passage formed therein throughout its length, a cutter blade mounted thereon at the leading end thereof and a nozzle leading to said passage; shock generating means mounted in said drifter means for giving a shock to said drilling rod means; rotation imparting means mounted on said drifter means for imparting a rotation to said drilling rod means; a tank containing a high viscosity fluid; booster means connected to said tank for pressurizing said high viscosity fluid, said booster means being communicated with said passage formed in said drilling rod means; and powder material supplying means for supplying a powder material or sand into said hole to seal the leading end of said drilled hole including said nozzle.

EXPLANATION OF THE BEST MODE OF THE INVENTION

Figure 1:
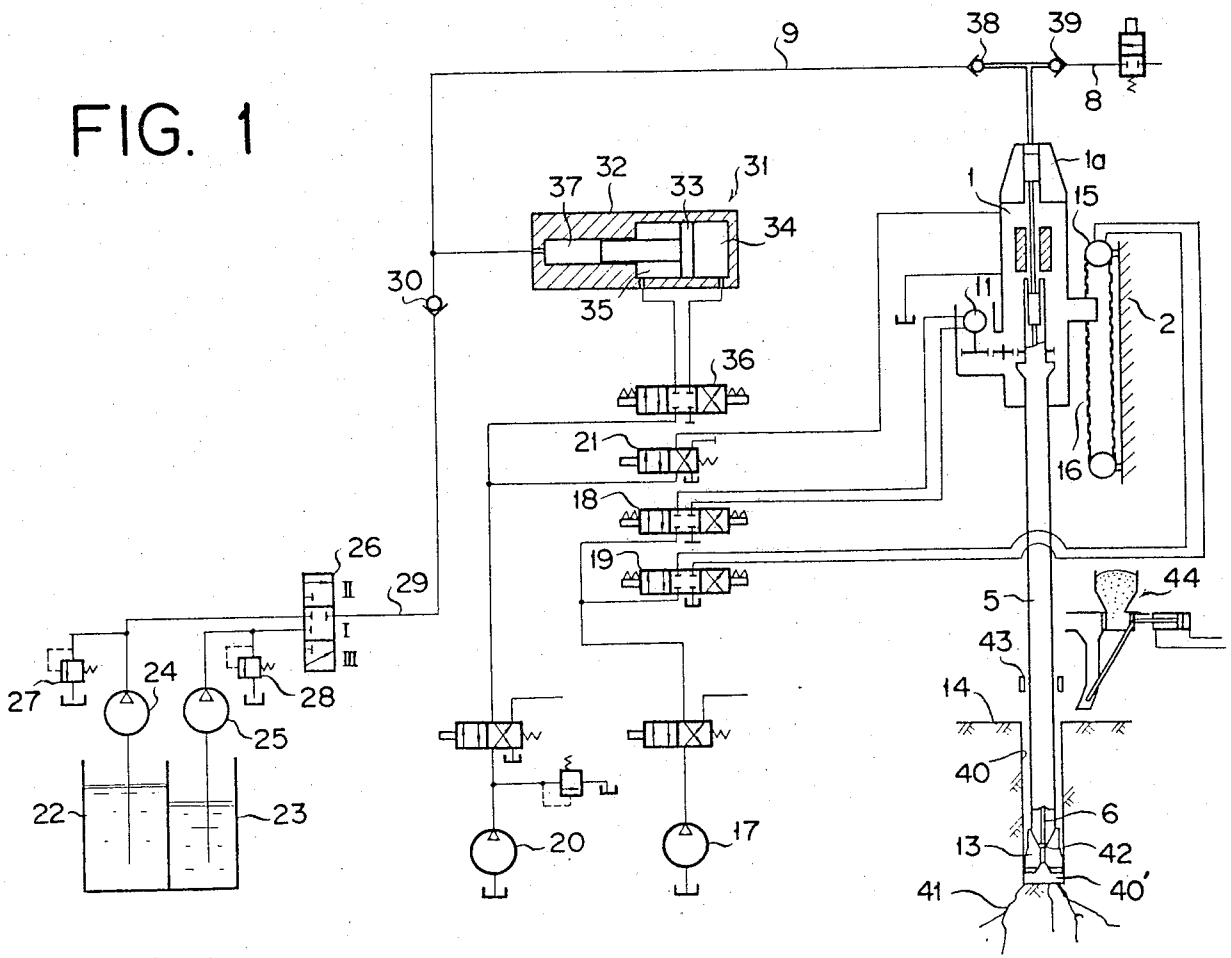
FIG. 1 is a schematic construction view of a rock bed preliminary fracturing apparatus according to the present invention.

The present invention will now be described in detail below with reference to the accompanying drawings. In the first place, referring to FIG. 1, reference numeral 1 denotes a drifter which is fitted to a guide member 2 of a construction vehicle etc., not shown. As shown in FIG. 2, accommodated within the drifter 1 is a striker piston 3 which is reciprocated within the drifter 1 by a hydraulic oil pressure or pneumatic pressure supplied through a change-over valve 4 and which strikes the upper end of a drilling rod 5 that is fitted in the leading end of the drifter 1. Formed in the central part of the above-mentioned drilling rod 5 is a passage 6, one end of which is connected in liquid tight with one end of a communicating pipe 7 that is inserted in the central part of the striker piston 3. The other end of the communicating pipe 7 leads to a head portion 1*a* of the drifter 1 so that the pneumatic pressure or high pressure water or high viscosity fluid supplied by way of an air conduit 8 or a high pressure water conduit 9 into the head portion 1*a* of the drifter 1 can be fed under pressure through the passage 6 within the drilling rod 5 to the leading end of the rod. Further, accommodated in the lower part of the drifter 1 is a gear 10 which engages the upper end of the drilling rod 5 so as to rotate as an integral part of the latter. The gear 10 meshs with a drive gear 12 adapted to be rotated by a motor 11 which is fitted to one side of the drifter 1 so that the drilling rod 5 is rotated or driven by the motor 11 and rock bed 14 can be drilled by a bit or drilling blade 13 attached to the leading end of the drilling rod 5.

Whilst, part of the above-mentioned drifter 1 is engaged with a drive means 16 such as a chain or screwed rod which is rotated by a motor 15 along a guide member 2 so that the drifter 1 can be moved up and down by the drive means 16 along the guide member 2.

Hydraulic oil under pressure is supplied by a hydraulic oil pump 17 into the motors 11 and 15 through change-over valves 18 and 19, respectively so as to drive these motors 11 and 15, and the hydraulic oil pressure for driving the striker piston 3 inside the drifter 1 is supplied by a hydraulic oil pump 20 through a change-over valve 21.

Reference numeral 22 denotes a tank for a high viscosity fluid, and 23 a water tank, both tanks being connected to a change-over valve 26 through pumps 24 and 25, respectively. A high viscosity fluid can be obtained, for example, by adding bentonite to water and further by the addition of a viscosity increasing agent of cellulose group. Another high viscosity fluid can be obtained by adding powder of starch group in place of bentonite, and a fluid having a similar viscosity can be obtained by adding a viscosity increasing agent of high molecular polyethylene group. Relief valves 27 and 28 are provided on the delivery sides of the pumps 24 and 25, respectively. The change-over valve 26 has three positions, that is; position I where the valve is shut off, position II where the high viscosity fluid tank 22 is connected to a conduit 29, and position III where the water tank 23 is connected to the conduit 29. The change-over valve 26 is connected through a check valve 30 to a booster 31. The booster 31 includes a piston 33 slidably mounted within a cylinder 32, A cylinder head side chamber 34 and a piston rod side chamber 35 of the booster are connected to the aforementioned pump 20 through a change-over valve 36 and a pressurization chamber 37 is connected through the conduit 29 to the change-over valve 26. The pressurization chamber 37 is further connected via the conduit 9 and a check valve 38 to the communicating pipe 7 secured in the striker piston 3. The communicating pipe 7 is connected through a check valve 39 and by way of the air conduit 8 to an air compressor (not shown). The booster 31 serves to draw a high viscosity fluid or water into the pressurization chamber 37 by introducing the hydraulic oil pressure from the pump 20 into the piston rod side chamber 35 through the change-over valve 36 and then pressurize the high viscosity fluid or water in the pressurization chamber 37 to a high pressure by subsequently changing over the change-over valve 36 so as to introduce the hydraulic oil into the cylinder head side chamber 34.

The fluid thus pressurized is supplied through the conduit 9 and the check valve 38 into the head portion 1*a* of the drifter 1 and is then injected through the communicating pipe 7, the passage 6 within the drilling rod 5 and a nozzle 42 formed in the leading end of the drilling rod 5 to bottom part 40′ of a hole 40. The high pressure fluid thus injected penetrates into cracks 41 in the rock bed.

Figure 3:
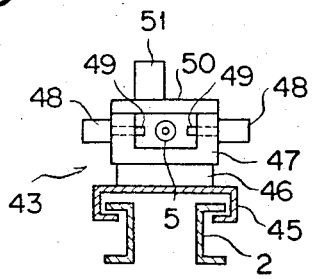
FIG. 3 is a detailed view showing the drilling rod and a clamping mechanism thereof.

Provided on the lower end side of the aforementioned guide member 2 are a clamp means 43 adapted to clamp the drilling rod 5 at any desired position and a muck or sand supply means 44. The clamp means 43 comprises, as shown in FIG. 3, a base 45 which can be moved freely relative to the guide member 2 and fixedly secured thereto, and a frame 47 fitted to the base 45 through a resilient mount 46. Inserted in the frame 47 is the drilling rod 5 to be clamped, and the frame 47 has a pair of clamp cylinders 48 mounted therein at opposite positions in such a manner as to sandwich the drilling rod 5. The arrangement is made such that the drilling rod 5 can be clamped at any desired position by means of clamp claws 49 which can be extended from and retracted into the clamp cylinders 48. Further, a vibrator 51 is fitted to the aforementioned frame 47 through a mounting plate 50, and by actuating the vibrator 51 while the drilling rod 5 is clamped by means of the clamp claws 49, the vibration caused by the vibrator 51 can be transmitted to the drilling rod 5.

Figure 4:
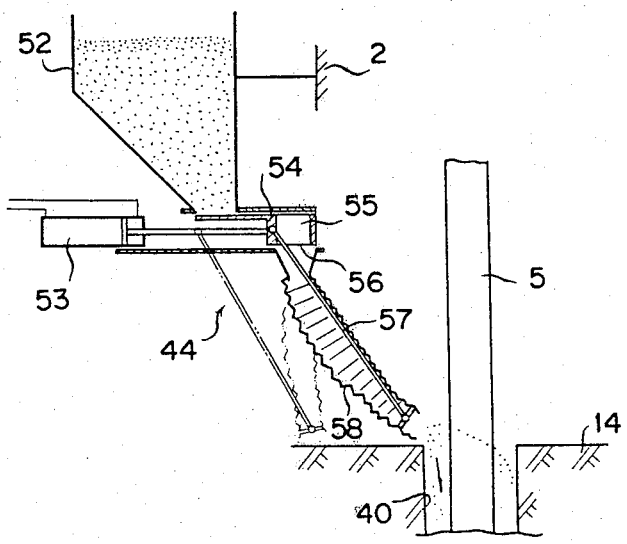
FIG. 4 is a schematic view of a rock muck supplying apparatus.

Besides, the muck supply means 44 supplying muck into the hole 40 which has been drilled has, as shown in FIG. 4, a hopper 52 supported by the guide member 2. Installed in the bottom part of the hopper 52 is a device 54 for supplying a predetermined amount of muck which can be reciprocated by a hydraulic cylinder 53. The device 54 for supplying a predetermined amount of muck serves to push to a drop port 56 a predetermined amount of muck which is necessary for sealing and which has dropped from the hopper 52 into a muck supply chamber 55. The upper end of a rod 57 is fitted to the device 54 for supplying a predetermined amount of muck. When the device 54 is moved by the action of the cylinder 53, it will move together with a bellows-shaped chute 58 attached to the rod 57. Therefore, with the movements of the device 54, a predetermined amount of muck (rock chips) or sand is supplied from the hopper 52 into the drilled hole 40.

Further, in order to accelerate the drop of muck, an air discharge port (not shown) may be provided above the drop port 56, and also a rotary feeder or the like may be utilized as the means for supplying a predetermined amount of muck. Further, other kind of sand, soil and sawdust or the mixture thereof may, of course, be employed as the sealing power.

Figure 5:
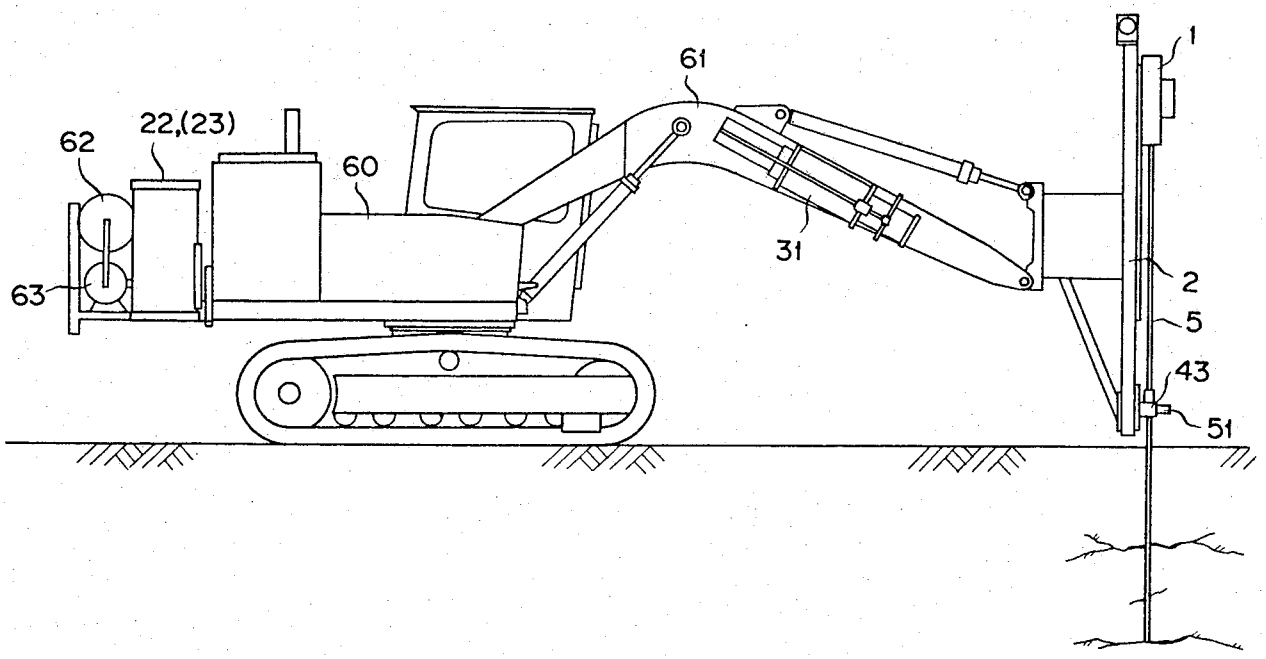
FIG. 5 is a side elevational view of a revolving excavator vehicle having a rock bed preliminary fracturing apparatus of the present invention mounted thereon.

In practical use, the aforementioned preliminary rock bed fracturing device is mounted on an arm 61 of a revolving excavator vehicle 60, for example, as shown in FIG. 5, and also the high viscosity fluid tank 22, the water tank 23, a compressor tank 62 and a compressor 63 etc. are mounted on the vehicle 60 and put to use.

The operation of the rock bed preliminary fracturing device according to the present invention will be explained hereinbelow. The revolving excavator vehicle 60 having the rock bed preliminary fracturing device mounted thereon is located on the rock bed to be fractured. The bit 13 fitted to the leading end of the drilling rod 5 is positioned on the surface of the rock bed to be fractured, and the pump 20 is driven to supply hydraulic oil under pressure into the drifter 1 so that the striker piston 3 slidably mounted in the drifter 1 is reciprocated so as to strike the upper end of the drilling rod 5. At that time, the motor 11 is simultaneously driven so as to transmit its rotation to the drilling rod 5. By striking the drilling rod 5 while it is being rotated, the rock bed 14 is drilled by the bit 13 fitted to the leading end of the drilling rod 5. At that time, the excavated rock chips; that is, muck can be blown off outside the hole 40 by driving the air compressor 63 and spouting compressed air from the nozzle 42 through the conduit 8 and the passage 6.

Figure 6:
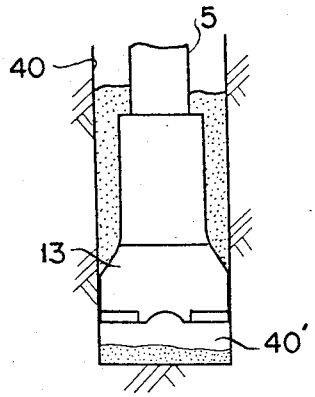
FIG. 6 is a schematic view showing a state in which a bit portion is sealed by rock mucks.

With the progress of the drilling work, the drifter 1 is lowered along the guide member 2. When the hole 40 being drilled has reached a desired depth, the drilling work is suspended, and in the next place, a predetermined amount of muck is introduced into the hole 40 by means of the muck supply means 44. The muck introduced into the hole 40 will accumulate along the ramp of the bit 13 as shown in FIG. 6 thereby sealing the periphery of the bit 13. Moreover, at that time, the actuation of the vibrator 51 while the drilling rod 5 is clamped by the clamp means 43 so as to transmit the vibration caused by the vibrator to the drilling rod 5 will promote the drop of the muck thrown into the hole 40 downwards thereof thereby increasing the effect of sealing the hole 40.

When the leading end 40' of the hole 40 is sealed by the muck, pulling the drilling rod 5 upward a little after the muck has been thrown into the hole will consolidate the muck between the bit portion and the inner wall of the hole 40 thereby enabling a strong seal to be provided. When it is desired to release the seal thus formed, the bit is moved down until it contacts with the bottom of the hole and subsequently compressed air is spouted through the nozzle so as to enable the muck to scatter.

When the leading end 40' of the hole 40 including the nozzle 42 has been sealed by the muck, the pump 24 and the booster 31 are driven so as to allow the high viscosity fluid under a high pressure to spout through the nozzle 42. The expression "a high pressure" referred to above is meant by about 100 to 1,000 kg/cm$^2$, more preferably, 200 to 600 kg/cm$^2$. In brief, by driving the pump 24 and also changing the change-over valve 26 over to the position II, the high viscosity fluid in the tank 22 is introduced into the pressurization chamber 37. Then, at the same time, the pump 20 is driven so as to supply hydraulic oil under pressure through the change-over valve 36 into the piston rod side chamber 35 of the booster 31 thereby promoting the drawing of the high viscosity fluid into the pressurization chamber 37. When the change-over valve 36 is changed over to introduce hydraulic oil under pressure into the cylinder head side chamber 34, the piston 33 is moved to the left thereby pressurizing the high viscosity fluid in the pressurization chamber 37 so as to spout from the nozzle 42 through the conduit 9, the communicating pipe 7 and the passage 6. The high viscosity fluid spouted from the nozzle 42 will fill the bottom part of the sealed hole 40 and then penetrate into the cracks 41 which inherently exist in the rock bed thereby sealing these cracks in the first place.

Further emission or spouting of the high viscosity fluid from the nozzle 42 will produce many new cracks in the rock bed or expand the original cracks 41. This process will complete the preliminary fracturing work, and so the driving of the pump 24 and the booster 31 etc. is stopped. The completion of the preliminary fracturing can be judged to some degree by observing the exudation of water on the surface of the rock bed.

Further, since the high viscosity fluid is expensive, if the change-over valve 26 is changed over to the position III when it is judged that the cracks in the rock bed have been clogged with the high viscosity fluid, and at the same time, the pump 25 is driven and the water in the water tank 23 is pressurized by the booster 31 so as to spout the water from the nozzle 42, then the natural cracks 41 will expand in the same manner as the aforementioned case and also a great many new large cracks will be produced so as to enable preliminary fracturing of the rock bed to be made.

In the case where the high viscosity fluid injection is changed over to high pressure water injection in the course of the process, the fracturing efficiency will reduce but is economical as compared to the case where the high viscosity fluid is continuously injected.

After preliminarily fracturing the rock bed by repeating the foregoing operations, ripping operations can be effected by means of a construction vehicle such as bulldozer. As a result, the fracturing and excavation of the rock bed can be carried out efficiently.

Figure 2:
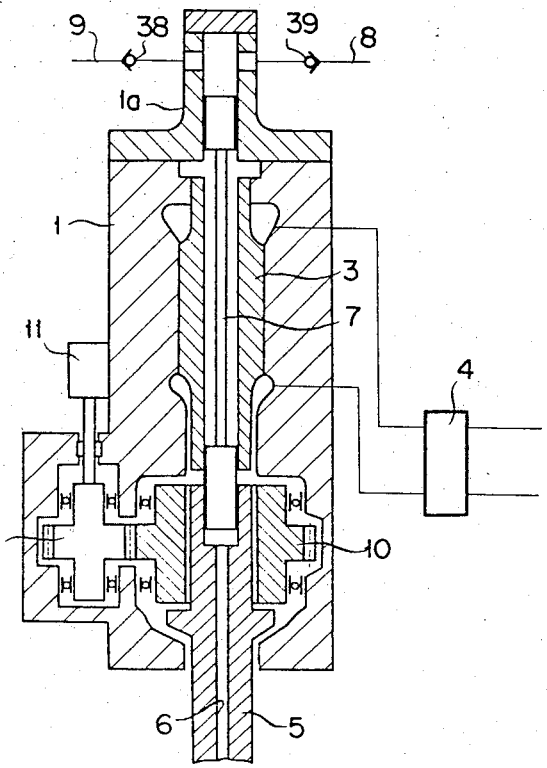
FIG. 2 is a cross-sectional view showing a drifter and a drilling rod mounted therein.
Figure 7:
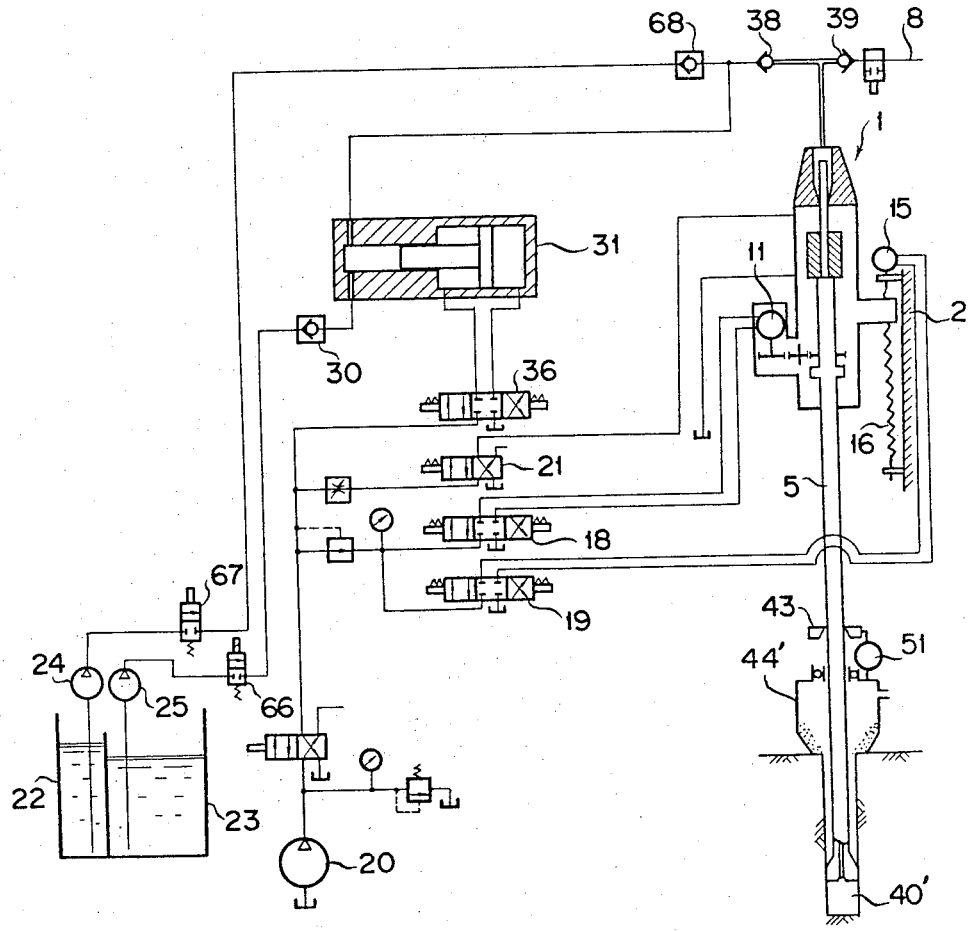
FIG. 7 is schematic construction view of another embodiment of a rock bed preliminary fracturing apparatus according to the present invention.

FIG. 7 shows another embodiment of the rock bed preliminary fracturing device according to the present invention which is generally similar to the first embodiment shown in FIG. 1. The main differences between the two embodiments will be explained below.

Figure 8:
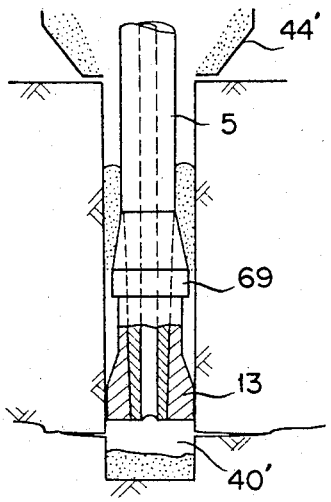
FIG. 8 is a schematic view showing a state in which a drilling rod having a coller mounted thereon is sealed by rock mucks.

Only the water tank 23 is connected through the pump 25, the change-over valve 66 and the check valve 30 to the booster 31, whilst the high viscosity fluid tank 22 is directly connected to the communicating pipe 7 within the drifter 1, not through the booster 31, but through the pump 24, the change-over valve 67 and the check valve 68. The arrangement is made such that the pump 24 is driven so as to inject the high viscosity fluid by the pump's delivery pressure into the leading end 40' of the sealed hole thereby filling the natural cracks in the rock bed, and then the pump 25 is driven so as to pressurize water by the booster 31 to a high pressure to allow the highly pressurized water to be injected from the nozzle formed in the leading end of the drilling rod 5 thereby performing the preliminary fracturing of rock beds. Because an appreciably high pressure is not required until the natural cracks in the rock bed is filled with the high viscosity fluid, the tank 22 for the high viscosity fluid is not connected to the booster 31. In addition thereto, the pump 17 used in the embodiment of FIG. 1 is omitted, and the change-over valves 18 and 19 are connected to the pump 20. Another difference of this embodiment from the first embodiment is that a muck reservoir and supply means 44' is installed in contact with the ground surface in contrast to the muck supply means 44 of FIG. 1. This muck reservoir and supply means 44' is resiliently suspended relative to the guide member 2 through a vibration-proof rubber etc., and the vibrator 51 is fitted to the muck reservoir and supply means 44'. The arrangement is made such that compressed air is ejected from the nozzle during drilling of the rock bed so as to scatter the muck thereby to accumulate it within the muck reservoir and supply means 44'. When sealing the leading end 40' of the hole 40 with muck, the vibrator 51 is driven so as to forcibly drop the muck into the hole 40. Referring to FIG. 8, the portion of the drilling rod 5 near the leading end thereof is formed with a tapered collar 69 so that the space between the collar 69 and inner wall surface of the hole 40 may be sealed with the muck. When forming the seal, regardless whether the collar 69 is provided or not, pulling the drilling rod 5 upwards to some degree under the condition a sufficient amount of muck has accumulated in the hole enables the muck to be consolidated sufficiently between the outer peripheral surface of the drilling rod 5 and the inner wall surface of the hole 40 thereby obtaining a good seal.

Figure 9:
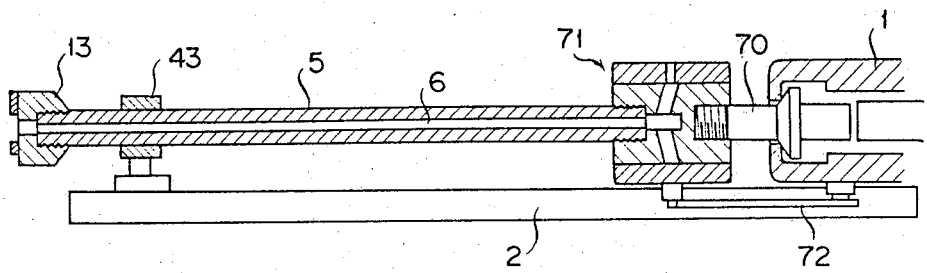
FIG. 9 is a longitudinal cross-sectional view showing another embodiment of a connection between the drifter and the drilling rod.
Figure 10:
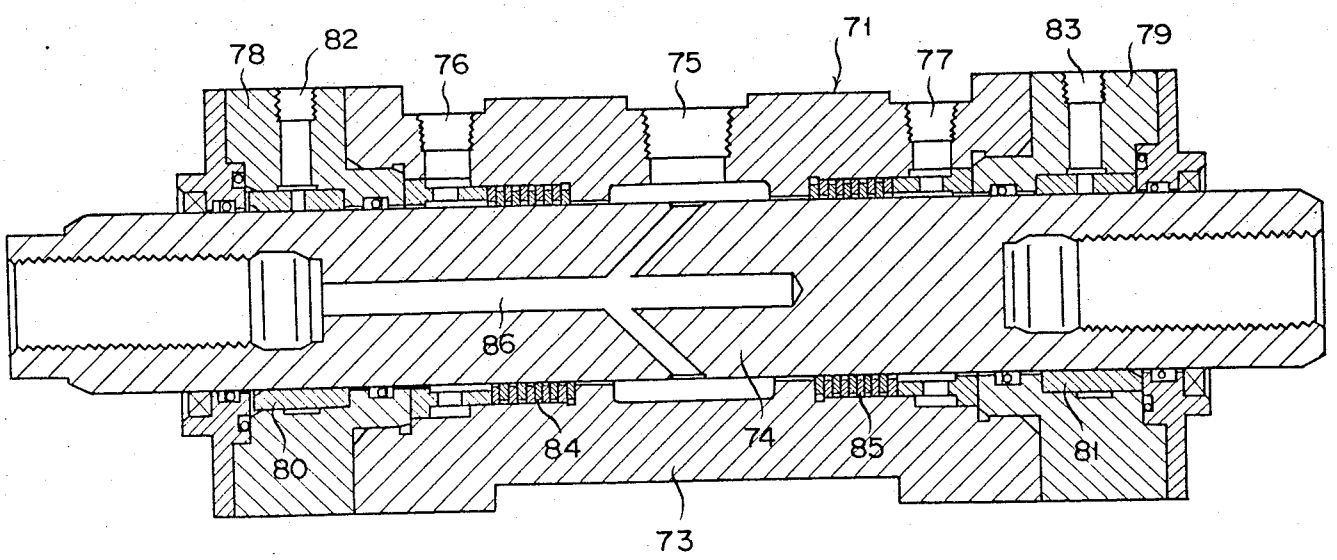
FIG. 10 is an enlarged cross-sectional view of the swivel joint shown in FIG. 9.

Referring to FIGS. 9 and 10, there is shown another embodiment of the joint of the present invention for supplying a high pressure fluid to the drilling rod which can be turned.

In FIG. 9, the drifter 1 is movably mounted on the guide member 2, and connected through a swivel joint 71 to a shank 70 of the drifter 1 is the base end portion of the drilling rod 5. The drifter 1 is connected to the swivel joint 71 by means of a connecting member 72 so that all these component parts can be moved as an integral unit along the guide member 2, and the leading end of the drilling rod 5 is supported by a guide 43. Further, the drilling rod 5 has a passage 6 for the fluid under pressure formed therein, and the bit 13 fitted to the leading end thereof. The swivel joint 71 comprises, as shown in FIG. 10, an outer cylindrical portion 73 and a rotating shaft 74 which is rotatably accommodated within the outer cylindrical portion 73. The outer cylindrical portion 73 has a hydraulic fluid supply port 75 formed in the central part thereof and drain ports 76 and 77 formed on the opposite sides relative to the port 75. Further, end plates 78 and 79 for blocking both ends of the outer cylindrical portion 73 are formed, respectively, with oil ports 82 and 83 for supplying lubricating oil into bearings 80 and 81 carrying the above-mentioned rotating shaft 74. Mounted on both sides of the above-mentioned hydraulic fluid supply port 75 are a pair of sealing means 84 and 85 which are located between the outer cylindrical portion 73 and the rotating shaft 74. The sealing means 84 and 85 each comprises a plurality of seal rings which are arranged in such a manner that the inner and outer peripheral faces thereof are alternately located adjacent the outer cylindrical portion 73 and the rotating shaft 74 and the side faces thereof are in sliding contact with one another so that the liquid tightness of the fluid supply port 75 is ensured by the sealing means 84 and 85, and also the hydraulic fluid which leaks through the sealing means 84 and 85 is drained into a tank not shown through the drain ports 76 and 77. Further, one end of the above-mentioned rotating shaft 74 is connected to the leading end of the shank 70 and the other end thereof is connected to the base end portion of the drilling rod 5 by means of screwing, and also formed in the rotating shaft 74 is a communicating passage 86 which communicates the passage 6 within the drilling rod 5 with the hydraulic fluid supply port 75.

As described hereinabove, according to the embodiment of the joint shown in FIGS. 9 and 10, the hydraulic fluid under a high pressure supplied into the fluid supply port 75 of the outer cylindrical portion 73 will flow from the communicating passage 86 of the rotating shaft 74 into the passage 6 within the drilling rod 5 regardless of the rotation of the rotating shaft 74 so as to enable the hydraulic fluid to be supplied to the leading end of the drilling rod 5.

Further, the pair of sealing means 84 and 85 are mounted between the outer cylindrical portion 73 and the rotating shaft 74 in such a manner as to sandwich the fluid supply port 75. The clearances formed between the inner and outer peripheries of the sealing means 84 and 85, the outer cylindrical portion 73 and the rotating shaft 74 acts as labyrinth seals so that the high pressure fluid can be supplied safely and surely from the outer cylindrical portion 73 towards the side of the rotating shaft 74. Furthermore, since the inner and outer peripheries of each seal ring means 84 and 85 are arranged alternately in close proximity to the outer cylindrical portion 73 and the rotating shaft 74, a possible eccentricity of the shaft 74, and a decrease in the sealing effect accompanied thereby can be eliminated.

Figure 11:
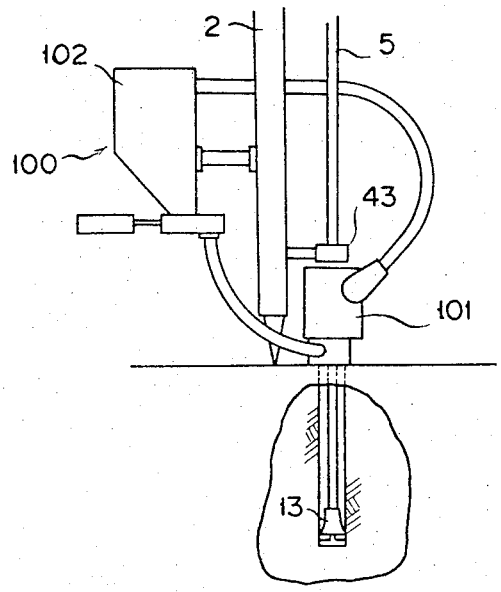
FIG. 11 is a schematic view of a rock bed preliminary fracturing apparatus provided with another embodiment of a rock muck recovering and supplying apparatus.
Figure 12:
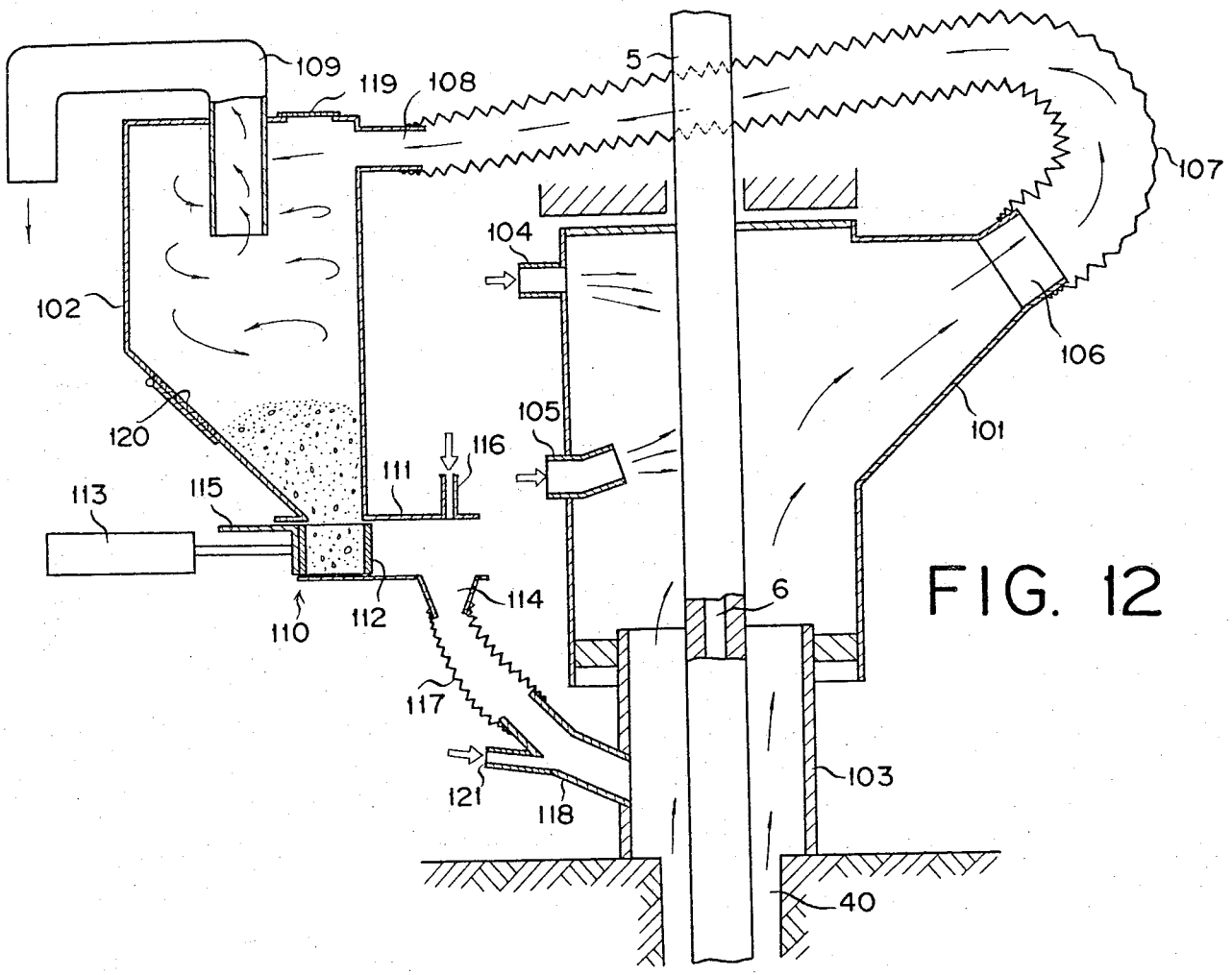
FIG. 12 is an enlarged cross-sectional view of the rock muck recovering and supplying apparatus shown in FIG. 11.

Referring to FIGS. 11 and 12, there is shown another embodiment of the muck and sand supply means used for carrying out the present invention. According to this embodiment, the muck scattered from the drilled hole by the air blown therein is recovered and supplied into the hole for the purpose of sealing, and therefore the term "muck recovery and supply means" is more suitable.

In FIG. 11, reference numeral 100 denotes a body of this means which is installed in the lower part of the guide member 2 and which comprises a recovery tank 101 in which the drilling rod 5 is inserted and which is fixedly secured to the rod guide 43, and a supply tank 102. The recovery tank 101 has a sealing cylinder 103 fitted to the lower part thereof and which is brought into contact with the ground surface to keep air-tightness. The arrangement is made such that the muck which has ascended into the recovery tank 101 together with the air through the hole 40 and the sealing cylinder 103 can be blown out through an outlet 106 provided in the upper part of the recovery tank 101 by the air blown therein through air blowing-in ports 104 and 105 provided in the upper part and middle part thereof. Connected to the outlet 106 is one end of a flexible pipe 107 such as hose. The other end of the flexible pipe 107 is connected to an inlet 108 provided in the upper part of the aforementioned supply tank 102 so that the muck fed through the flexible pipe 107 can be accommodated in the supply tank 102. The bottom part of the supply tank 102 is of a hopper shape and the inlet 108 is arranged so that the air containing the muck blown through the inlet 108 into the supply tank 102 can turn or gyrate therein as shown by arrows, and also a inverted U shaped discharge pipe 109 is fitted to the upper and central part of the supply tank 102 so that the comparatively fine particles of the muck can be discharged with the air thereby enabling only comparatively uniform and coarse particles of the muck to accumulate in the bottom part of the supply tank 102. Further, installed in the bottom part of the supply tank 102 is a device 110 for supplying a predetermined amount of muck. The device 110 has a guide box 111 connected to a bottom opening of the supply tank 102. Accommodated within the guide box 111 is a horizontally movable box 112 for storing a predetermined amount of muck. The box 112 can accommodate therein a predetermined amount of muck which has dropped from the inside of the supply tank 102. The box 112 can be reciprocated freely by means of a drive cylinder 113 towards a drop port 114. When the box 112 for storing a predetermined amount of muck is being moved towards the drop port 114, a baffle plate 115 provided on the box 112 shuts off a lower opening of the supply tank 102 so as to prevent the muck from dropping into the guide box 111, and also when the box 112 has reached the drop port 114, the muck in the box 112 will drop into the drop port 114 together with the air blown therein through an air blowing-in port 116 provided above the drop port 114. One end of the flexible pipe 117 is connected to the drop port 114 so that the muck which has dropped can be guided into a muck throwing-in port 118 formed in the peripheral face of the sealing cylinder 103 and also the muck which has reached the muck throwing-in port 118 can be supplied through the sealing cylinder 103 into the hole 40.

Thus, in drilling a rock bed, in the first place, the recovery tank 101 is located in the position shown in FIG. 12 and impact and rotation is transmitted by the drifter etc. to the drilling rod so that the rock bed can be drilled by the bit 13 fitted to the leading end of the drilling rod 5. The muck produced by the drilling is blown through the inside of the hole 40 into the recovery tank 101 by the action of the air which is ejected through the passage 6 formed within the drilling rod 5 and through the bit portion 13. The muck which has been recovered in the recovery tank 101 is sent into the supply tank 102 together with the air blown through the air blowing-in ports 104 and 105 into the recovery tank 101, and only the muck of a uniform and coarse particle size is accumulated in the bottom part of the supply tank 102.

In the next place, upon completion of the drilling of the rock bed and prior to proceeding to fracturing thereof, the box 112 is reciprocated by the drive cylinder 113 of the device 110 for supplying a predetermined amount of muck so that a predetermined amount of muck can be supplied into the hole 40 thereby sealing the clearance between the hole 40 and the drilling rod 5. By injecting water under pressure into the hole 40 under such condition, the rock bed can be fractured satisfactorily without causing pressure leaks.

Furthermore, in case the muck to be supplied into the hole 40 is of an improper quality, a cover member 119 fitted to the upper part of the supply tank 102 is opened so that separately prepared muck of a good quality can be fed into the tank 102. Further, in case the amount of recovery of muck is in excess of the amount of supply thereof and the amount of the muck which has accumulated in the supply tank 102 is more than the required one, a cover member 120 fitted to the lower part thereof is opened so as to remove the surplus amount of muck. Further, an air blowing-in port 121 formed in the muck throwing-in port 118 serves to eject air when the drilling rod 5 is withdrawn so as to prevent wet muck from proceeding into the muck throwing-in port 118, and also serves to eject air during the drilling of rock bed and before supplying muck so as to remove wet muck deposited to the muck throwing-in port 118.

What we claim is:

1. A preliminary fracturing method of a rock bed, comprising the steps of:

(a) drilling a hole in said rock bed to be fractured by means of a drilling rod, said drilling rod having a bit mounted thereon at the leading end thereof and a passage formed therein along the entire length of said rod, said bit having a slanted surface formed at an intermediate portion thereof and said passage leading to a nozzle formed in said bit;

(b) dumping a powder material such as rock muck or sand in the drilled hole with said drilling rod remaining inserted in the hole thereby allowing the powder material to accumulate on the slanted surface of said bit;

(c) causing a vibration to said drilling rod thereby tightly sealing a leading end portion of the hole by the powder material by consolidating the powder material accumulated on the slanted surface of said bit, said leading end portion including said nozzle;

(d) spouting a high viscosity fluid from said nozzle thereby allowing said high viscosity fluid to intrude into cracks existing in said rock bed and clogging them; and (e) spouting a highly pressurized high viscosity fluid from said nozzle thereby expanding said cracks or seams and producing a lot of new cracks in said rock bed.

2. A preliminary fracturing method of a rock bed, comprising the steps of:

(a) drilling a hole in said rock bed to be fractured by means of a drilling rod, said drilling rod having a bit mounted thereon at the leading end thereof and a passage formed therein along the entire length of said rod, said bit having a slanted surface formed at an intermediate portion thereof and said passage leading to a nozzle formed in said bit;

(b) dumping a powder material such as rock muck or sand in the drilled hole with said drilling rod remaining inserted in the hole thereby allowing the powder material to accumulate on the slated surface of said bit;

(c) causing a vibration to said drilling rod thereby tightly sealing a leading end portion of the hole by the powder material by consolidating the powder material accumulated on the slated surface of said bit, said leading end portion including said nozzle;

(d) spouting a high viscosity fluid from said nozzle thereby allowing said high viscosity fluid to intrude into cracks existing in said rock bed and clogging them; and (e) spouting a highly pressurized water from said nozzle thereby expanding said cracks and producing a lot of new cracks in said rock bed.

3. A preliminary fracturing method of a rock, bed, comprising the steps of:

(a) drilling a hole in said rock bed to be fractured by means of a drilling rod, said drilling rod having a bit mounted thereon at the leading end thereof and a passage formed therein along the entire length of said rod, said bit having a slanted surface formed at an intermediate portion thereof and said passage leading to a nozzle formed in said bit;

(b) dumping a powder material such as rock muck or sand in the drilled hole with said drilling rod remaining inserted in the hole thereby allowing the powder material to accumulate on the slated surface of said bit;

(c) causing a vibration to said drilling rod thereby tightly sealing a leading end portion of the hole by the powder material by consolidating the powder material accumulated on the slanted surface of said bit, said leading end portion including said nozzle;

(d) spouting highly pressurized high viscosity fluid from said nozzle thereby allowing said highly pressurized high viscosity fluid to intrude into cracks existing in said rock bed and clogging them; and (e) continuously spouting said highly pressurized high viscosity fluid from said nozzle thereby expanding said cracks and producing a lot of new cracks in said rock bed.

4. A preliminary fracturing method of a rock bed as recited in claim 1, 2 or 3 wherein step (c) further includes lifting said drilling rod slightly while causing a vibration thereto thereby further promoting consolidation of the powder material.

5. A fracturing method of a rock bed as recited in claim 1, 2 or 4 wherein after fracturing said rock bed preliminarily, said preliminarily fractured rock bed is fractured by subjecting it under ripping operation.

6. An apparatus for preliminary fracturing a rock bed, comprising:

(a) a guide member adapted to be mounted on a construction vehicle;

(b) drifter means movably mounted on said guide member;

(c) drilling rod means slidably and rotatably mounted in said drifter means, said drilling rod means having a passage formed therein throughout its length, a bit mounted thereon at the leading end thereof and a nozzle leading to said passage;

(d) shock generating means mounted in said drifter means for giving a shock to said drilling rod means;

(e) rotation imparting means mounted to said drifter means for imparting a rotation to said drilling rod means;

(f) a tank containing a high viscosity fluid;

(g) booster means connected to said tank for pressurizing said high viscosity fluid, said booster means being communicated with said passage formed in said drilling rod means; and (h) powder material supplying means for supplying a powder material such as rock muck or sand into said hole to seal the leading end of said drilled hole including said nozzle.

7. An apparatus for preliminary fracturing rock bed as recited in claim 6 further comprising a second tank containing water therein connected directly to said passage formed in said drilling rod means.

8. An apparatus for preliminary fracturing rock bed as recited in claim 6 further comprising a second tank containing water therein and selector valve means disposed between said booster means and said tank and second tank for selectively connecting said tank and said second tank with said booster means.

9. An apparatus for preliminary fracturing rock bed as recited in claim 6 further comprising swivel joint means for introducing said high viscosity fluid into said passage of said drilling rod means, said swivel joint means comprising:

an outer cylinder having a fluid supply port formed therein;

a rotary shaft rotatably mounted in said outer cylinder, said rotary shaft having formed therein a passage connected to the passage formed in said drilling rod means; and a pair of seal means mounted between said outer cylinder and said rotary shaft sandwiching said fluid supply port.

10. An apparatus for preliminary fracturing rock bed as recited in claim 9 wherein said seal means comprises a plurality of seal rings, adjacent each pair being in contact with each other and alternately disposed closer to the inner periphery of said outer cylinder and to the outer periphery of said rotary shaft.

11. An apparatus for preliminary fracturing rock bed as recited in claim 6 wherein said powder material supplying means comprises:

a recovery box for recovering rock mucks produced during the drilling together with the air spouted from the nozzle of the leading end of said drilling rod;

a supply box for storing said rock mucks sent therein with air and supplying said stored rock mucks into said drilled hole; and constant supply means mounted to the bottom of said supply box for supplying metered amount of rock mucks into said drilled hole.

* * * * *